US008695153B2

(12) United States Patent
Treitz et al.

(10) Patent No.: US 8,695,153 B2
(45) Date of Patent: Apr. 15, 2014

(54) SURFACE CLEANING HEAD AND SURFACE CLEANING ARRANGEMENT

(75) Inventors: Felix Treitz, Winnenden (DE); Stefan Schilpp, Alfdorf (DE)

(73) Assignee: Alfred Kärcher GmbH Co. KG, Winnenden (DE)

( * ) Notice: Subject to any disclaimer, the term of this patent is extended or adjusted under 35 U.S.C. 154(b) by 25 days.

(21) Appl. No.: 13/618,917

(22) Filed: Sep. 14, 2012

(65) Prior Publication Data

US 2013/0061418 A1 Mar. 14, 2013

Related U.S. Application Data

(63) Continuation of application No. PCT/EP2011/053778, filed on Mar. 14, 2011.

(30) Foreign Application Priority Data

Mar. 19, 2010 (DE) ..... 10 2010 003 079

(51) Int. Cl.
*A47L 7/00* (2006.01)
*A47L 5/16* (2006.01)

(52) U.S. Cl.
USPC ..... 15/320; 15/409

(58) Field of Classification Search
USPC ..... 15/320, 409
IPC ..... A47L 7/00,5/16
See application file for complete search history.

(56) References Cited

U.S. PATENT DOCUMENTS

| | | | |
|---|---|---|---|
| 4,895,179 | A | 1/1990 | Hart |
| 6,273,154 | B1 | 8/2001 | Laug |
| 2006/0234616 | A1 | 10/2006 | Holzwarth et al. |

FOREIGN PATENT DOCUMENTS

| | | | |
|---|---|---|---|
| DE | 91 09 460 | U1 | 9/1991 |
| DE | 100 37 082 | A1 | 2/2002 |
| DE | 100 66 009 | B4 | 2/2002 |
| DE | 103 13 396 | B4 | 10/2003 |
| WO | WO 2010/142347 | A1 | 12/2010 |

*Primary Examiner* — David Redding
(74) *Attorney, Agent, or Firm* — Womble, Carlyle Sandridge & Rice, LLP

(57) ABSTRACT

A surface cleaning head for cleaning a surface is provided that includes a housing that has a cleaning chamber surrounded by a peripheral wall and open at the bottom, and in which a cleaning nozzle is mounted on a spray arm and is freely rotatable about a rotational axis, and a jet pump for suctioning off cleaning fluid applied to a surface, the jet pump having a pump inlet channel connected to a combining channel via a mixing chamber, and a motive nozzle upstream from the combining channel. To improve the surface cleaning head, the pump inlet channel is oriented radially with respect to the spray arm and connected to the peripheral wall of the cleaning chamber, the diameter of the combining channel is 14 to 18 mm, and the distance between the motive nozzle and the combining channel is at least 10 mm.

22 Claims, 4 Drawing Sheets

SURFACE CLEANING HEAD AND SURFACE CLEANING ARRANGEMENT

CROSS-REFERENCE TO RELATED APPLICATIONS

This application is a continuation of international application number PCT/EP2011/053778, filed on Mar. 14, 2011, which claims priority to German Appl. No. 10 2010 003 079.1, filed on Mar. 19, 2010, both of which are incorporated herein by reference in their entirety and for all purposes.

BACKGROUND OF THE INVENTION

The invention relates to a surface cleaning head for cleaning a surface, comprising a housing that has a cleaning chamber which is surrounded by a peripheral wall and open at the bottom, and in which at least one cleaning nozzle is mounted on a spray arm so as to be freely rotatable about an axis of rotation for applying cleaning fluid to the surface to be cleaned, and comprising a jet pump for suctioning off cleaning fluid that is applied to the surface, the jet pump having a pump inlet channel that is in flow connection with the cleaning chamber and is connected to a combining channel via a mixing chamber, a motive nozzle for forming a suction flow being situated upstream from the combining channel.

The invention further relates to a surface cleaning arrangement having a surface cleaning head and an outlet line.

This type of surface cleaning head is known from U.S. Pat. No. 4,895,179. A spray lance of a high-pressure cleaning appliance may be connected to the surface cleaning head so that the cleaning nozzle situated on the spray arm may be supplied with pressurized cleaning fluid by the high-pressure cleaning appliance. The cleaning fluid may be sprayed onto the surface to be cleaned by means of the cleaning nozzle. The nozzle thus experiences a recoil, thereby setting the spray arm in rotation about the axis of rotation. At least two diametrically opposite spray arms, each carrying a cleaning nozzle, are usually used, whereby the nozzles may be simultaneously acted on by pressurized cleaning fluid.

In addition to the cleaning nozzles, the known surface cleaning head has a jet pump which operates according to the principle of a Venturi pump. The jet pump is situated above the housing, and is in flow connection with the cleaning chamber via a connecting line leading alongside the cleaning chamber. The jet pump includes a pump inlet channel which is connected to a mixing chamber, and a combining channel downstream from the mixing chamber. Upstream from the combining channel, a motive nozzle is in alignment with the combining channel, and may be acted on by pressurized cleaning fluid so that a suction flow forms in the mixing chamber and the combining channel. A diffuser is connected to the combining channel. An outlet line may be connected to the diffuser. The suction flow generated by the motive nozzle allows the fluid that is applied to the surface to be cleaned, together with removed dirt, to be suctioned off and discharged via the outlet line.

For operating the surface cleaning head known from U.S. Pat. No. 4,895,179, the surface cleaning head is supplied with cleaning fluid under a pressure of at least 207 bar at a delivery rate of at least 1,620 liters per hour. Due to the high pressure of the cleaning fluid and the high delivery rate, a suction flow may be formed by means of the jet pump which is strong enough to effectively suction off the cleaning fluid that is applied to the surface to be cleaned.

Surface cleaning heads having at least one rotating cleaning nozzle which may be supplied with pressurized cleaning fluid and which have a jet pump for suctioning off the cleaning fluid that is applied to the surface are also known from DE 100 66 009 B4 and DE 103 13 396 B4. In these surface cleaning heads as well, the cleaning fluid is supplied to the motive nozzle under high pressure and at a high delivery rate.

It is an object of the present invention to improve a surface cleaning head of the generic kind in such a way that the pressure and the delivery rate of the cleaning fluid may be reduced without significant losses of suction force of the suction pump.

SUMMARY OF THE INVENTION

For a surface cleaning head of the type stated at the outset, this object is achieved according to the invention in that the longitudinal axis of the pump inlet channel is oriented radially with respect to the axis of rotation of the at least one spray arm, and the pump inlet channel is connected to the peripheral wall of the cleaning chamber, the diameter of the combining channel being 14 mm to 18 mm, and the distance between the motive nozzle and the combining channel being at least 10 mm.

In the surface cleaning head according to the invention, the pump inlet channel is connected to the cleaning chamber along a longitudinal axis that is aligned in the radial direction. The pump inlet channel is connected to the combining channel via the mixing chamber, and the motive nozzle is situated upstream from the combining channel. Thus, the mixing chamber as well as the motive nozzle are situated at a short distance from the cleaning chamber, and thus also at a short distance from the surface to be cleaned. As a result, an effective suction flow is formed in the cleaning chamber, with the aid of which the surface to be cleaned may be suctioned, and the pressure of the cleaning fluid supplied to the motive nozzle may be selected to be lower than for the surface cleaning head known from U.S. Pat. No. 4,895,179. For example, the pressure of the cleaning fluid supplied to the motive nozzle may be less than 150 bar, and the delivery rate may be less than 800 liters per hour, in particular less than 600 liters per hour.

A further increase in the effectiveness of the surface cleaning head is achieved according to the invention in that the diameter of the combining channel is 14 mm to 18 mm. For smaller combining channel diameters, although a considerable delivery pressure is formed at the outlet of the combining channel, the transmission of air through the combining channel is relatively low. For large diameters, a high air transmission rate is obtained, but only a relatively low delivery pressure then results at the outlet of the combining channel, so that there is a risk that the cleaning fluid may no longer be reliably transported up to the free end of an outlet line via which the fluid conveyed by the jet pump is discharged. In combination with a distance of at least 10 mm, in particular a distance of at least 15 mm, between the motive nozzle and the combining channel, for a combining channel diameter of 14 mm to 18 mm, a considerable suction flow may be generated not only in the region of the pump inlet channel, but also in the region of an outlet line, in particular a discharge hose, situated downstream from the combining channel. This has the advantage that the cleaning fluid suctioned off from the surface to be cleaned may be discharged via the outlet line even in case the outlet line has a certain upward oblique inclination with respect to the horizontal. This provides the user with the option, for example, of cleaning a terrace, the outlet line extending along an ascending floor area or surmounting a small garden wall, for example. The surface to be cleaned may thus be effectively suctioned, and the sucked away cleaning fluid may be placed under a considerable delivery pressure by the jet pump so that it may be discharged in a reliable manner.

In an advantageous embodiment of the invention, the distance between the motive nozzle and the combining channel is at most 60 mm.

In particular a distance of 40 mm between the motive nozzle and the combining channel has proven to be particularly advantageous in order to generate a particularly effective suction flow for suctioning the surface to be cleaned and to place the sucked-up fluid under a considerable delivery pressure at the lowest possible pressure of the cleaning fluid that is supplied to the motive nozzle, and at the lowest possible delivery rate of the cleaning fluid, so that the sucked-up fluid may be discharged in a reliable manner.

The distance between the motive nozzle and the combining channel is preferably 1.3 to 4.3 times the diameter of the combining channel For providing an effective suction flow, it is advantageous for the distance between the motive nozzle and the combining channel to be at least 1.3 times the diameter of the combining channel. Thus, the motive nozzle should not be situated directly at the inlet of the combining channel. On the other hand, the distance between the motive nozzle and the inlet of the combining channel should also preferably not be greater than 4.3 times the diameter of the combining channel, since otherwise the suction flow is impaired.

The length of the combining channel is preferably at least 10 mm. In particular, a length of 20 mm has proven to be advantageous for increasing the effectiveness of the jet pump.

It is advantageous if a diffuser is connected to the combining channel and has an opening angle of 4° to 12°, in particular an opening angle of 8°. The diffuser forms a line portion which is connected to the combining channel and continuously widens. The achievable suction flow may be improved in this way.

The combining channel and the diffuser advantageously have a combined length of at least 30 mm.

The ratio of the diameter of the combining channel to the combined length of the combining channel and the diffuser is advantageously 0.13 to 0.25.

In a preferred embodiment of the invention, the motive nozzle is formed as a cone jet nozzle, the opening angle of the cone jet being 15° to 40°. The opening angle of the cone jet is advantageously 20° to 25°.

In a particularly preferred embodiment of the invention, the housing has an outer wall which surrounds the peripheral wall of the cleaning chamber, the pump inlet channel being mounted on the peripheral wall and on the outer wall. In particular, it may be provided that the pump inlet channel protrudes through the outer wall to the outside. Thus, the pump inlet channel extends, at least partially, inside the housing, namely, in the region between the peripheral wall of the cleaning chamber and the outer wall of the housing. The installation space of the surface cleaning head may thus be kept relatively low. The pump inlet channel may protrude beyond the housing to the outside at its end region that faces away from the cleaning chamber. This increases the stability not only of the pump inlet channel, but also of the portions of the outer wall and of the peripheral wall connected to the pump inlet channel. Thus, the pump inlet channel not only has the function of establishing a flow connection between the cleaning chamber and the mixing chamber of the jet pump, but also forms a mechanical reinforcing element which increases the mechanical stability of the surface cleaning head.

At least three support elements are advantageously situated in the region between the peripheral wall of the cleaning chamber and the outer wall of the housing for supporting the surface cleaning head on the surface to be cleaned. The support elements may be provided, for example, in the form of rollers or casters, with the aid of which the surface cleaning head may be moved along the surface to be cleaned.

The peripheral wall of the cleaning chamber preferably has a circular cylindrical shape, and in top view, the outer wall of the housing preferably has a triangular shape with rounded corner regions, one support element being situated in each corner region. The support elements are thus overlapped by the housing, and the surface cleaning head has a very compact design overall.

It is advantageous if a pump outlet channel which defines the mixing chamber and the combining channel, and optionally also the diffuser, is mounted at the end of the pump inlet channel that faces away from the peripheral wall of the cleaning chamber. The pump outlet channel is preferably aligned coaxially with the pump inlet channel.

It is advantageous for the housing of the surface cleaning head, the pump inlet channel, and the pump outlet channel to be integrally joined to one another. The housing, pump inlet channel, and pump outlet channel are preferably formed as an integral molded plastics part. The manufacturing and assembly costs of the surface cleaning head may thus be kept low.

In an advantageous embodiment, the assembly of the surface cleaning head is simplified in that the motive nozzle is mounted on a nozzle mounting which is insertable into the pump inlet channel and mechanically connectable to the pump inlet channel. The nozzle mounting is preferably latchable to the pump inlet channel. In a first assembly step, the motive nozzle may be fixed to the nozzle mounting, and the nozzle mounting together with the motive nozzle fixed thereto may be subsequently inserted into the pump inlet channel and mechanically connected thereto.

In an advantageous embodiment of the invention, the nozzle mounting is connected, via a second line portion extending above the at least one spray arm within the cleaning chamber, to a first line portion which passes through a top wall of the cleaning chamber. The motive nozzle which is fixed to the nozzle mounting may be supplied with pressurized cleaning fluid via the line portions. In such a configuration, the surface cleaning head is characterized by a particularly compact design.

It is advantageous if the surface cleaning head has a distributor unit which is connected to the at least one cleaning nozzle via a first branch line, and to the motive nozzle via a second branch line, a supply line being pivotably mounted on the distributor unit. The spray lance of a high-pressure cleaning appliance, for example, may be connected to the supply line. The distributor unit may be supplied with pressurized cleaning fluid via the spray lance and the supply line. The distributor unit is connected to the at least one cleaning nozzle via the first branch line so that the surface to be cleaned may be sprayed with cleaning fluid, and is connected to the motive nozzle via the second branch line so that the motive nozzle may be acted on by pressurized cleaning fluid to form a suction flow. As mentioned above, the second branch line may have a first line portion which passes through the top wall of the cleaning chamber, and a second line portion which is connected to the first line portion and extends within the housing to the nozzle mounting of the motive nozzle.

The motive nozzle advantageously extends into the mixing chamber.

It is advantageous if the mixing chamber tapers conically in the direction of the combining channel. The mixing chamber preferably has the shape of a truncated cone, and extends from the pump inlet channel to the combining channel. The cone angle of the mixing chamber is preferably 20° to 50°, in particular 25° to 35°. A cone angle of 30° is particularly advantageous.

The combining channel is advantageously cylindrical.

The pump inlet channel likewise preferably has a conical taper; i.e., the flow cross-section of the pump inlet channel is reduced in the direction of the mixing chamber.

The pump inlet channel preferably has a wedge-shaped design.

In an advantageous embodiment, the pump inlet channel has two side walls oriented at an angle to one another. The side walls are preferably oriented at an angle of 90° to one another.

A connecting device for connecting to the outlet line is advantageously situated downstream from the combining channel. In particular, it may be provided that the pump outlet channel is releasably connectable to the outlet line via the connecting device.

It is advantageous if a coupling device having a connection diameter of 28 mm to 40 mm and which is connected to the outlet line is connectable to the connecting device. Pressure losses during discharge of the sucked-up fluid may thus be kept low, while a considerable flow velocity may still be formed. The outlet line and the coupling device may preferably engage with one another. For example, the outlet line may engage with or be fitted onto a tubular coupling element of the coupling device.

The invention further relates to a surface cleaning arrangement for cleaning a surface, comprising a surface cleaning head which is preferably formed as described above, and comprising an outlet line which is connected to the surface cleaning head, the surface cleaning head including a housing having a cleaning chamber which is surrounded by a peripheral wall and open at the bottom, in the cleaning chamber at least one cleaning nozzle being mounted on a spray arm so as to be freely rotatable about an axis of rotation for applying cleaning fluid to the surface to be cleaned, and the surface cleaning head for suctioning off cleaning fluid that is applied to the surface including a jet pump having a pump inlet channel that is in flow connection with the cleaning chamber and is connected to a combining channel via a mixing chamber, a motive nozzle for forming a suction flow being situated upstream from the combining channel, and the outlet line being connected to the surface cleaning head downstream from the combining channel. To be able to reduce the pressure and the delivery rate of the cleaning fluid that is supplied to the surface cleaning arrangement without impairing the suction force of the jet pump, the longitudinal axis of the pump inlet channel is oriented radially with respect to the axis of rotation of the at least one spray arm, and the pump inlet channel is connected to the peripheral wall of the cleaning chamber, and the diameter of the combining channel is one-third to two-thirds the internal diameter of the outlet line.

As a result of the radial orientation of the pump inlet channel which is directly connected the peripheral wall of the cleaning chamber, and due to the selection of the diameters of the combining channel and the outlet line in a ratio of one-third to two-thirds, effective suctioning of the surface that is sprayed with cleaning fluid and effective discharge of the sucked-up fluid and the removed dirt may be achieved at a reduced pressure and decreased delivery rate of the cleaning fluid that is supplied to the surface cleaning head. In particular, an internal diameter of the outlet line of 28 mm to 40 mm is advantageous.

The following description of a preferred embodiment of the invention serves for explanation in greater detail in conjunction with the drawings.

DETAILED DESCRIPTION OF THE INVENTION

Figure 1:
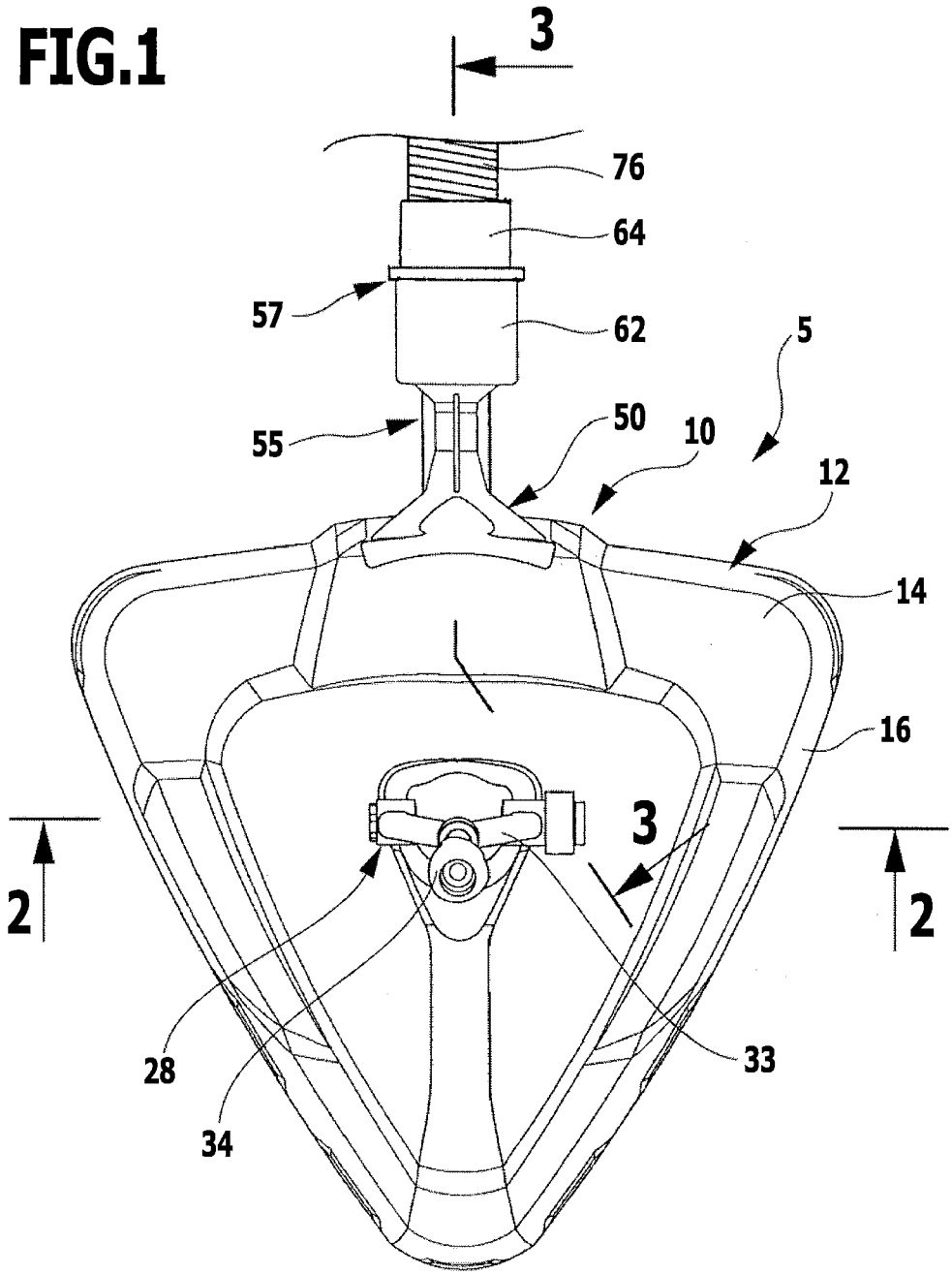
FIG. 1 shows a schematic top view of a surface cleaning arrangement, having a surface cleaning head to which an outlet line is connected.
Figure 2:
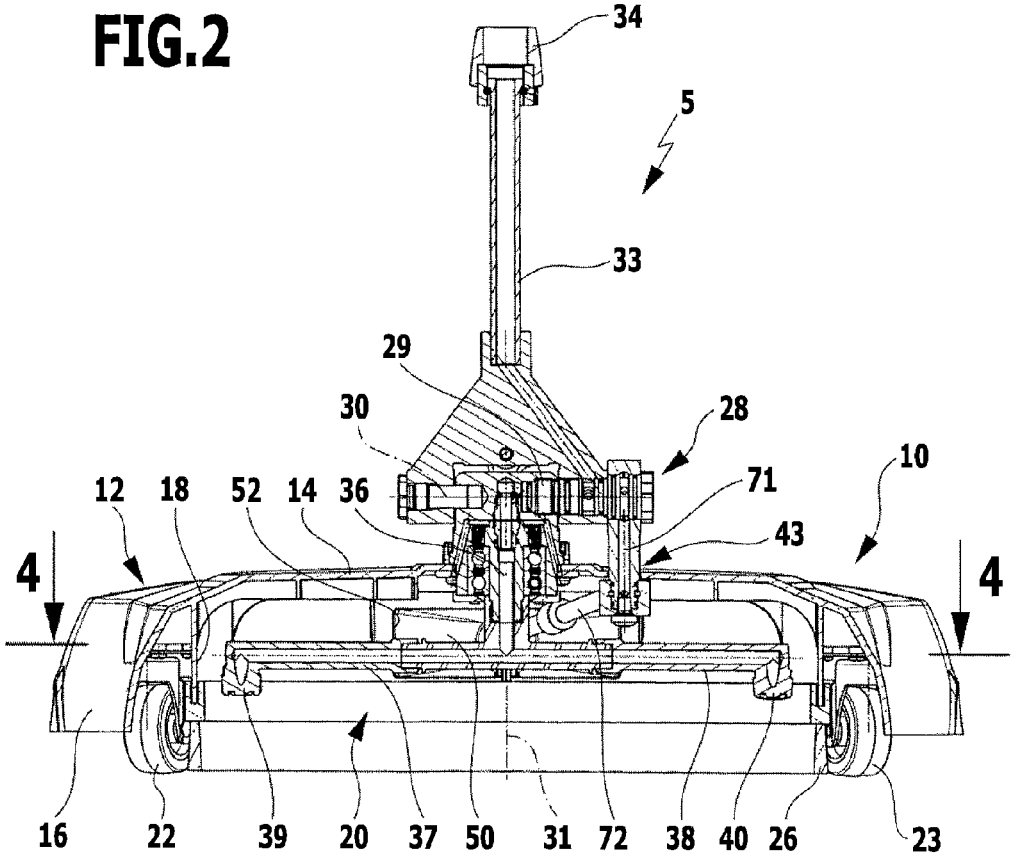
FIG. 2 shows a sectional view of the surface cleaning head along the line 2-2 in FIG. 1.
Figure 3:
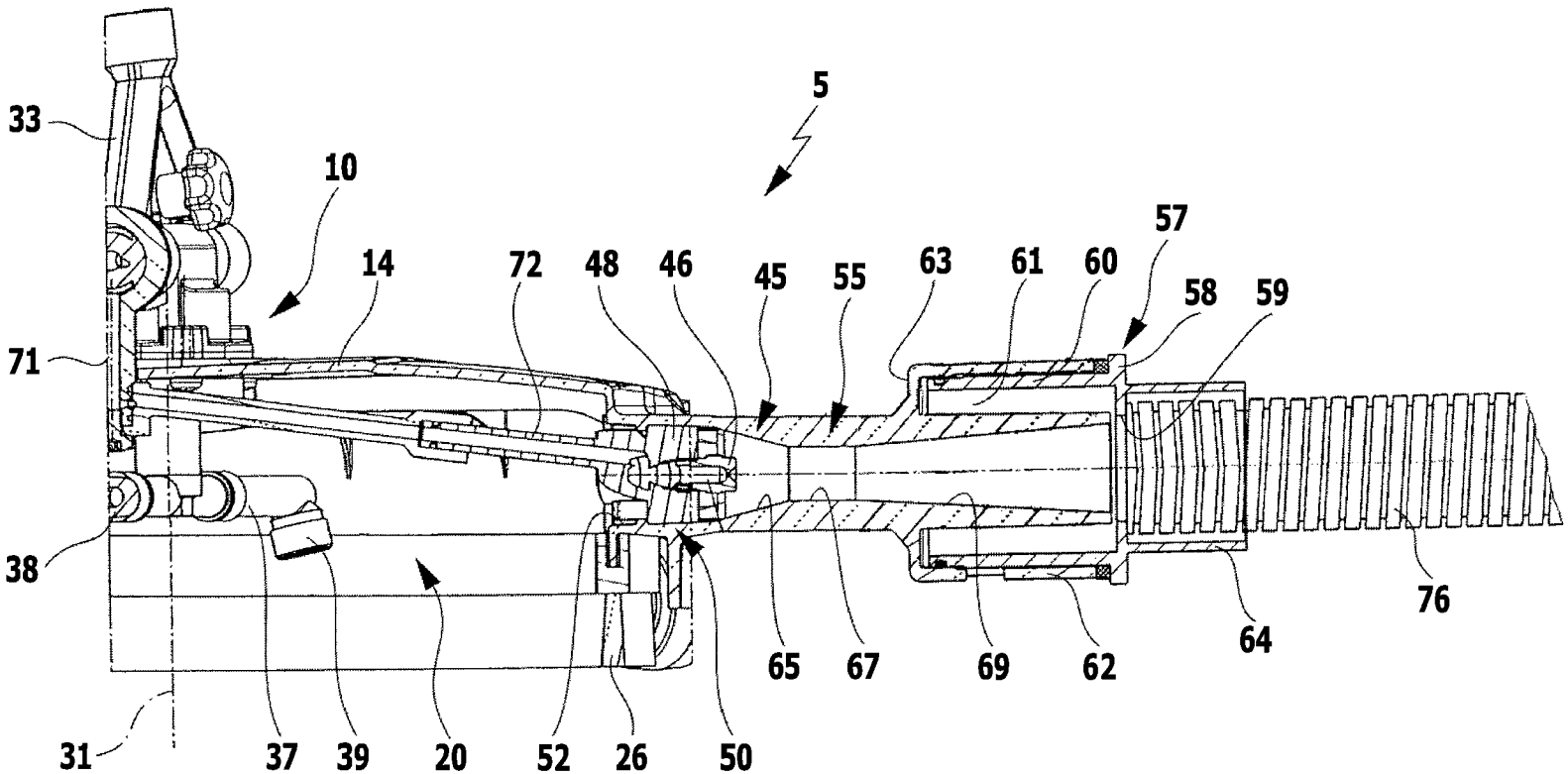
FIG. 3 shows a sectional view of the surface cleaning head along the line 3-3 in FIG. 1.

The drawing schematically illustrates a surface cleaning arrangement 5 according to the invention having a surface cleaning head 10 according to the invention. The surface cleaning head 10 has a hood-like housing 12, which in the top view has a substantially triangular shape with rounded corners. The housing 12 includes a top wall 14, the outer edge of which is connected to an outer wall 16. A circular cylindrical peripheral wall 18 which surrounds a cleaning chamber 20 projects downwardly from the top wall 14 at a distance from the outer wall 16. In the region between the outer wall 16 and the peripheral wall 18, support elements in the form of support wheels 22, 23, and 24 are respectively associated with each corner region of the housing 12, by means of which the surface cleaning head 10 can be supported on a surface to be cleaned, and the surface cleaning head 10 can be moved along the surface to be cleaned.

A circumferential splash guard and sealing element in the form of a bristle strip 26 is situated at the free edge of the peripheral wall 18, by means of which the cleaning chamber 20 can be sealed off with respect to the surface to be cleaned, and the escape of spray water from the cleaning chamber 20 may be prevented.

Situated above the top wall 14 is a distributor unit 28 that has a distributor line 29, the longitudinal axis 30 of which is oriented perpendicularly with respect to the cylinder axis 31 that is defined by the cylindrical peripheral wall 18.

The distributor unit 28 forms a bearing element on which a supply line 33 is mounted so as to be pivotable about the longitudinal axis 30 of the distributor line 29. At its free end that faces away from the housing 12, the supply line 33 carries a connecting element 34 to which, for example, a spray lance of a high-pressure cleaning appliance, which is known per se and therefore not illustrated in the drawing, may be connected.

The supply line 33 opens into the distributor line 29, which is connected to a first branch line 36 that is aligned coaxially with the cylinder axis 31 and extends into the cleaning chamber 20, and at its free end, carries two diametrically opposite spray arms 37, 38. The two spray arms 37 and 38 each carry a cleaning nozzle 39 and 40, respectively, at their free end. A surface to be cleaned in the region enclosed by the bristle strip 26 may be sprayed with cleaning fluid by means of the cleaning nozzles 39 and 40. The cleaning nozzles 39 and 40 generate an obliquely downwardly directed liquid jet of a cleaning fluid, which, upon exiting from the cleaning nozzles 39, 40, exerts a torque on the spray arms 37, 38, thus setting them in rotation about the cylinder axis 31.

Figure 4:
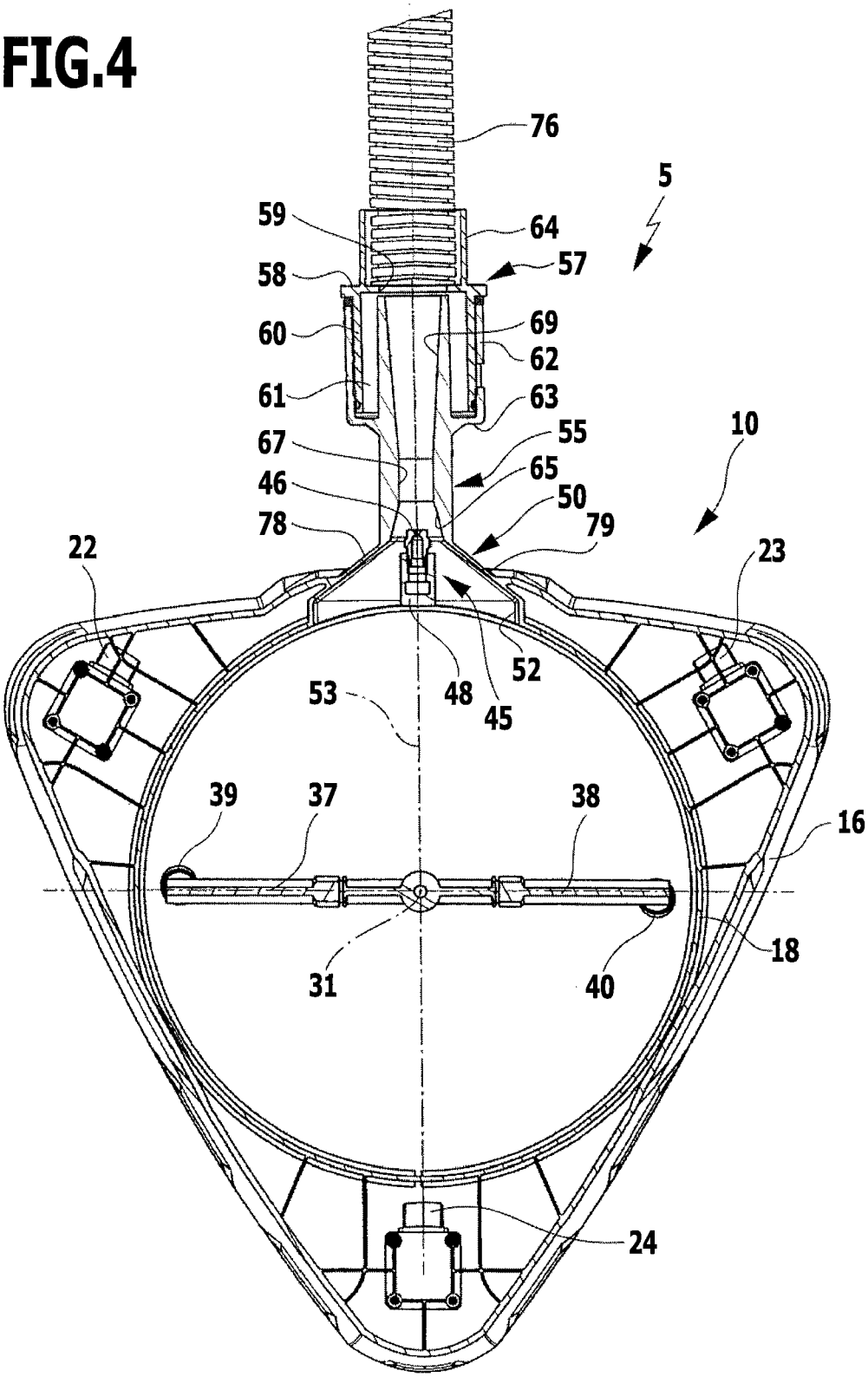
FIG. 4 shows a sectional view of the surface cleaning head along the line 4-4 in FIG. 2.

The distributor line 29 is in flow connection with a jet pump 45 via a second branch line 43. The jet pump includes a motive nozzle 46 which is fixed to a nozzle mounting 48. The nozzle mounting 48 is inserted into a pump inlet channel 50 and is mechanically connected thereto. In the illustrated embodiment, the nozzle mounting 48 is latched to the pump inlet channel 50. The pump inlet channel 50 extends from a lateral opening 52 in the peripheral wall 18 and through the outer wall 16, along a longitudinal axis 53 oriented radially with respect to the cylinder axis 31; i.e., the pump inlet channel 50 protrudes outwardly beyond the housing 12. This is apparent in particular from FIG. 4. A pump outlet channel 55, which is aligned coaxially with the pump inlet channel 50 and carries a connecting device at its free end, is integrally connected to the pump inlet channel 50. The connecting device includes an annular space 61 which encloses the pump outlet channel 55 at its free end region and is externally delimited by a sleeve 62. The sleeve 62 is integrally joined to the pump outlet channel via a radially outwardly protruding shoulder 63. A coupling device 57 is connected to the connecting device. The coupling device 57 includes a coupling flange 58 having a central connection opening 59. A first socket piece 60 extends into the annular space 61 and is releasably connected to the sleeve 62, for example via a bayonet connection. On the side facing away from the first socket piece 60, a second socket piece 64 is molded onto the coupling flange 58, coaxially with the longitudinal axis 53. The second socket piece 64 forms a tubular coupling element into which an outlet line in the form of a flexible discharge hose 76 is inserted. The discharge hose 76 is non-detachably joined to the coupling device 57 by means of an adhesive, and together with the coupling device 57 may be separated from the pump outlet channel 55, and as necessary, connected to same. The internal diameter of the discharge hose 76 is advantageously identical to the diameter of the connection opening 59, and is preferably 28 mm to 40 mm.

The flow cross-section of the pump inlet channel 50 decreases in the region between the lateral opening 52 and the pump outlet channel 55. For this purpose, the pump inlet channel has two side walls 78, 79 which are oriented obliquely, namely, at an angle of 90°, relative to one another, as is apparent from FIG. 4.

Within the pump outlet channel 55, the pump inlet channel 50 is connected to a mixing chamber 65, which has a frusto-conical configuration and tapers conically in the direction facing away from the pump inlet channel 50 at a cone angle of 30°. In the pump outlet channel 55, the mixing chamber 65 is connected to a cylindrical combining channel 67 having a diameter of 14 mm to 18 mm and a length of 40 mm. The distance between the motive nozzle 46 and the combining channel 67 is at least 10 mm, in particular at least 15 mm, and at most 60 mm. In the illustrated exemplary embodiment, the distance is 40 mm. Within the pump outlet channel 55, in the direction facing away from the pump inlet channel 50, the combining channel 67 is connected to a diffuser 69, which expands conically in the direction facing away from the pump inlet channel 50; in the illustrated embodiment, the cone angle of the diffuser 69 is 8°. In its end region, the diffuser 69 is enclosed by the annular space 61, into which the first socket piece 60 of the coupling device 57 extends. The connection opening 59 adjoins at the end of the diffuser.

As previously mentioned, the motive nozzle 46 is mounted on the nozzle mounting 48. The motive nozzle 46 is in alignment with the combining channel 67, and at its free end extends into the mixing chamber 65. The flow connection between the motive nozzle 46 and the distributor line 29 is established via the second branch line 43. The second branch line has a first line portion 71 which starts at the distributor line 29 and passes through the top wall 14 of the housing 12 at a distance from the first branch line 36. Within the cleaning chamber 20, above the spray arms 37, 38, the first line portion 71 is connected to a second line portion 72 of the second branch line 43, on the free end of which the nozzle mounting 48 together with the motive nozzle 46 is mounted. The motive nozzle 46 is configured as a cone jet nozzle; i.e., it emits a liquid jet, shaped as a cone jet, which is directed toward the combining channel 67. In the illustrated embodiment, the opening angle of the cone jet is approximately 22°.

As mentioned above, the connection diameter of the coupling device 57, i.e., the diameter of the connection opening 59, as well as the internal diameter of the discharge hose 76, is 28 mm to 40 mm. The ratio of the diameter of the combining channel 67 to the connection diameter of the coupling device 57, and thus to the internal diameter of the discharge hose 76, is one-third to two-thirds.

The liquid jet emitted by the motive nozzle 46 strikes the combining channel 67, and according to the known Venturi principle, generates a suction flow which is directed into the pump inlet channel 50 and the pump outlet channel 55 connected thereto. By means of the suction flow, cleaning fluid which has been applied to the surface to be cleaned together with removed dirt may be picked up from the surface and discharged via the discharge hose 76. The discharge hose 76 is releasably connected to the pump outlet channel 55. Within the discharge hose 76, a liquid flow which is directed in the direction facing away from the surface cleaning head 10 forms under the action of the motive nozzle 46. Sucked-up cleaning fluid flows through the discharge hose 76, even when the hose has a certain upward inclination. Due to the radial orientation of the pump inlet channel 50 which is connected to the peripheral wall 18 and of the pump outlet channel 55 that is connected to the inlet channel, and due to the diameter of the combining channel 67 and the connection diameter of the coupling device 57, as well as the selected distances between the motive nozzle 46 and the combining channel 67, there is little risk of fluid in the discharge hose 76 flowing back to the surface cleaning head 10.

The surface cleaning head 10 is also characterized by high mechanical stability. The cleaning nozzles 39, 40, the same as the motive nozzle 46, are situated within the housing 12, and the second line portion 72 of the second branch line 43 also extends inside the housing 12 and is thus protected from mechanical damage. The pump inlet channel 50 is fixed both to the peripheral wall 18 and to the outer wall 16, forming a stable anchor for the pump outlet channel 55. The housing 12 together with the peripheral wall 18 and the outer wall 16, in combination with the pump inlet channel 50 and the pump outlet channel 55, forms an integral molded plastics part which has high mechanical stability and is manufacturable at low cost. The nozzle mounting 48 may be inserted into the pump inlet channel 50 through the lateral opening 52 in the peripheral wall 18 and latched thereto after the motive nozzle 46 has been fixed to the nozzle mounting 48 beforehand

The invention claimed is:

1. A surface cleaning head for cleaning a surface, comprising:

a housing that has a cleaning chamber which is surrounded by a peripheral wall and open at the bottom, and in which at least one cleaning nozzle is mounted on a spray arm so as to be freely rotatable about an axis of rotation for applying cleaning fluid to the surface to be cleaned; and a jet pump for suctioning off cleaning fluid that is applied to the surface, the jet pump having a pump inlet channel that is in flow connection with the cleaning chamber and is connected to a combining channel via a mixing chamber, a motive nozzle for forming a suction flow being situated upstream from the combining channel;

wherein the longitudinal axis of the pump inlet channel is oriented radially with respect to the axis of rotation of the at least one spray arm, and the pump inlet channel is connected to the peripheral wall of the cleaning chamber; and wherein the diameter of the combining channel is 14 mm to 18 mm, and the distance between the motive nozzle and the combining channel is at least 10 mm.

2. The surface cleaning head according to claim 1, wherein the distance between the motive nozzle and the combining channel is at most 60 mm.

3. The surface cleaning head according to claim 1, wherein the distance between the motive nozzle and the combining channel is 1.3 to 4.3 times the diameter of the combining channel.

4. The surface cleaning head according to claim 1, wherein the length of the combining channel is at least 10 mm.

5. The surface cleaning head according to claim 1, wherein a diffuser is connected to the combining channel and has an opening angle of 4° to 12°.

6. The surface cleaning head according to claim 5, wherein the combining channel and the diffuser have a combined length of at least 30 mm.

7. The surface cleaning head according to claim 1, wherein the motive nozzle is configured as a cone jet nozzle, the opening angle of the cone jet being 15° to 40°.

8. The surface cleaning head according to claim 1, wherein the housing has an outer wall which surrounds the peripheral wall of the cleaning chamber, the pump inlet channel being mounted on the peripheral wall and on the outer wall.

9. The surface cleaning head according to claim 8, wherein at least three support elements are situated in the region between the peripheral wall and the outer wall, for supporting the surface cleaning head on the surface to be cleaned.

10. The surface cleaning head according to claim 9, wherein the peripheral wall has a circular cylindrical shape, and in top view, the outer wall has a triangular shape with rounded corner regions, one support element being respectively situated in each corner region.

11. The surface cleaning head according to claim 1, wherein a pump outlet channel which defines the mixing chamber and the combining channel is mounted at the end of the pump inlet channel that faces away from the peripheral wall, and is connectable to an outlet line.

12. The surface cleaning head according to claim 11, wherein the housing, the pump inlet channel, and the pump outlet channel are integrally joined to one another.

13. The surface cleaning head according to claim 1, wherein the motive nozzle is mounted on a nozzle mounting which is insertable into the pump inlet channel and mechanically connectable to the pump inlet channel.

14. The surface cleaning head according to claim 13, wherein the nozzle mounting is connected, via a second line portion extending above the at least one spray arm within the cleaning chamber, to a first line portion which passes through a top wall of the cleaning chamber.

15. The surface cleaning head according to claim 1, wherein the surface cleaning head has a distributor unit which is connected to the at least one cleaning nozzle via a first branch line, and to the motive nozzle via a second branch line, a supply line being pivotably mounted on the distributor unit.

16. The surface cleaning head according to claim 1, wherein the motive nozzle extends into the mixing chamber.

17. The surface cleaning head according to claim 1, wherein the mixing chamber tapers conically in the direction of the combining channel.

18. The surface cleaning head according to claim 1, wherein the combining channel is cylindrical.

19. The surface cleaning head according to claim 1, wherein the flow cross-section of the pump inlet channel tapers in the direction facing away from the cleaning chamber.

20. The surface cleaning head according to claim 1, wherein a connecting device for connecting an outlet line is situated downstream from the combining channel.

21. The surface cleaning head according to claim 20, wherein a coupling device having a connection diameter of 28 mm to 40 mm and which is connected to the outlet line is connectable to the connecting device.

22. A surface cleaning arrangement for cleaning a surface, comprising:

a surface cleaning head according to claim 1; and an outlet line which is connected to the surface cleaning head, the surface cleaning head including a housing having a cleaning chamber which is surrounded by a peripheral wall and open at the bottom, in the cleaning chamber at least one cleaning nozzle being mounted on a spray arm so as to be freely rotatable about an axis of rotation for applying cleaning fluid to the surface to be cleaned, and the surface cleaning head for suctioning off cleaning fluid that is applied to the surface including a jet pump having a pump inlet channel that is in flow connection with the cleaning chamber and is connected to a combining channel via a mixing chamber, a motive nozzle for forming a suction flow being situated upstream from the combining channel, and the outlet line being connected to the surface cleaning head downstream from the combining channel, the longitudinal axis of the pump inlet channel being oriented radially with respect to the axis of rotation of the at least one spray arm, and the pump inlet channel being connected to the peripheral wall of the cleaning chamber;

wherein the diameter of the combining channel is one-third to two-thirds the internal diameter of the outlet line.

* * * * *